US005466156A

United States Patent [19]

Ramirez

[11] Patent Number: 5,466,156

[45] Date of Patent: Nov. 14, 1995

[54] DEVICE FOR TEACHING VOLLEYBALL HITTING TECHNIQUES

[76] Inventor: Angel L. P. Ramirez, 2815 Holiday Dr., Huntsville, Ala. 35805

[21] Appl. No.: 312,039

[22] Filed: Sep. 26, 1994

[51] Int. Cl.[6] ..... A63B 69/00

[52] U.S. Cl. ..... 434/247; 273/411; 472/116

[58] Field of Search ..... 273/411; 434/247, 434/248, 251, 258; 472/116, 117

[56] References Cited

U.S. PATENT DOCUMENTS

| | | | |
|---|---|---|---|
| 4,365,799 | 12/1982 | O'Brian et al. | 472/116 |
| 4,795,163 | 1/1989 | Szabo | 434/247 |
| 5,062,646 | 11/1991 | Crist | 273/29 A |
| 5,165,696 | 11/1992 | Saha | 273/411 |
| 5,238,251 | 8/1993 | Staka | 273/411 |
| 5,372,550 | 12/1994 | Gleeson et al. | 472/116 |

*Primary Examiner*—Edgar S. Burr
*Assistant Examiner*—Steven S. Kelley
*Attorney, Agent, or Firm*—John C. Garvin, Jr.

[57] ABSTRACT

A device for teaching or instructing a person the proper techniques for hitting a volleyball and breaking his fall when diving head first to hit the volleyball to avoid possible injury. The teaching and instructional device of the present invention generally comprises a frame, a curved support member, and a slide. The frame includes a ladder member having steps or rungs thereon, a leg member, and means for adjusting the height of the frame and associated elements to better accommodate persons of different heights. The curved support member may be fixed to or rotatably secured to the frame. The slide is pivotally secured at its upper end to the upper portion of the frame and includes means adjacent its lower end for adjusting the height of the lower end of the slide.

15 Claims, 2 Drawing Sheets

DEVICE FOR TEACHING VOLLEYBALL HITTING TECHNIQUES

FIELD OF THE INVENTION

This invention relates to a teaching or instructional aid, and more particularly to a device for teaching persons how to properly hit the volleyball and break his fall when diving head first to hit the volleyball.

BACKGROUND OF THE INVENTION

A person playing the game of volleyball often finds that he must dive head first to hit the volleyball, otherwise his team will lose a point or a serve. Diving to hit the volleyball will often injure the person if he is not aware of the proper techniques for breaking his fall after hitting the volleyball. This is especially true for young persons who are just beginning to learn the game of volleyball. There are no devices known to Applicant for teaching a person the proper techniques for diving to hit a volleyball and properly breaking the person's fall and preventing injury to such person.

It is therefore desirable to provide a device for teaching the proper techniques for diving and hitting the volleyball and preventing possible injury to volleyball players.

SUMMARY OF THE INVENTION

The instant invention relates to a device for teaching or instructing a person the proper techniques for hitting a volleyball and breaking his fall when diving head first to hit the volleyball to avoid possible injury to such person. The teaching and instructional device of the present invention generally comprises a frame, a rotatable drum or curved support surface and a slide. The frame includes a ladder member having steps or rungs thereon, a leg member, and means for adjusting the height of the frame and associated elements to better accommodate persons of different heights. The rotatable drum is rotatably secured to the frame and includes mechanisms for preventing rotatable movement of the drum in an undesired direction. The slide is pivotally secured at its upper end to the upper portion of the frame and includes means adjacent its lower end for adjusting the height of the lower end of the slide.

Accordingly, it is an object of the present invention to provide a device which is simple in construction, relatively inexpensive to manufacture, for teaching or instructing, a person the proper techniques for diving to hit a volleyball and breaking his fall to avoid possible injury to such person.

It is a further object of the present invention to provide a device which is simple in construction, relatively inexpensive to manufacture, for teaching a person the proper techniques of hitting a volleyball while diving head first and which builds up the confidence of the person to enable such person to become a better volleyball player.

These objects as well as other objects to the present invention will become more readily apparent to those skilled in the art from a study of the following description, and drawings and appended claims as pertaining to the preferred embodiments of the invention.

DESCRIPTION OF THE PREFERRED EMBODIMENTS

Figure 1:
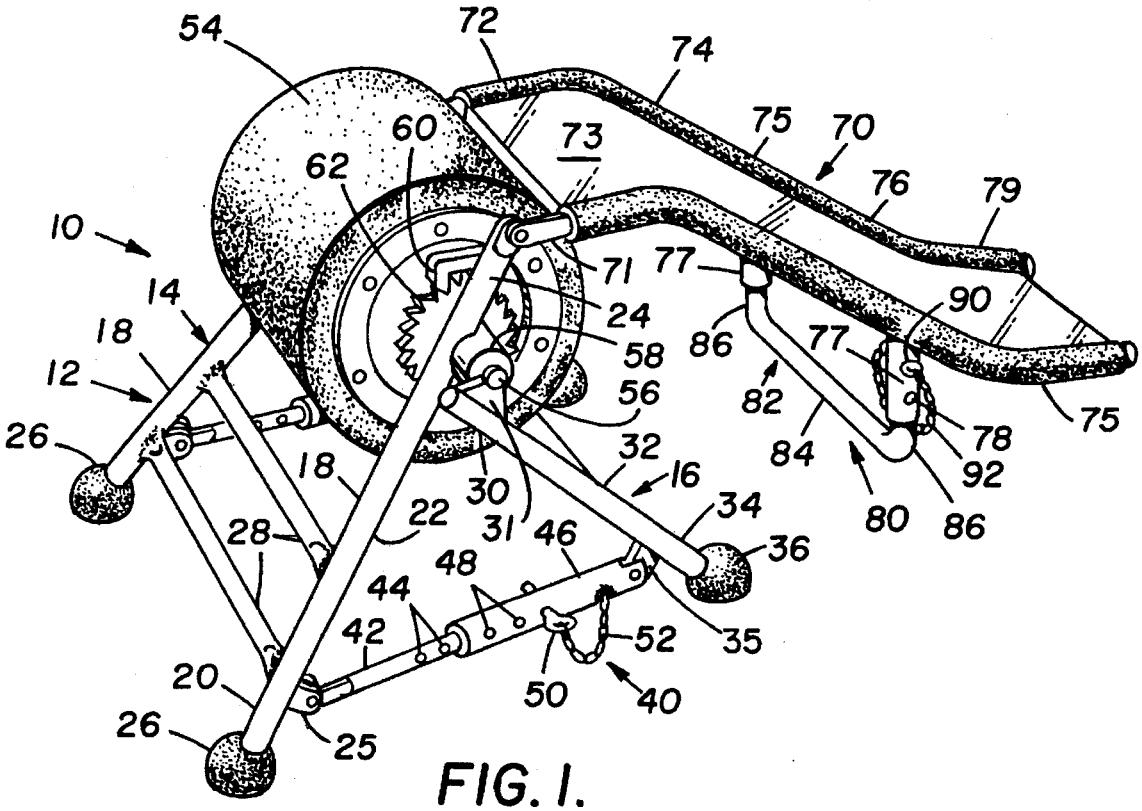
FIG. 1 is a perspective view of a first embodiment of the teaching device of the present invention.

Referring now to FIG. 1, reference numeral 10 designates the teaching device of the present invention showing a person thereon after mounting device 10. Teaching device 10 comprises a frame 12, a rotatable drum 54 and a slide 70. Frame 12 includes a ladder member 14 and a leg member 16. Ladder member 14 includes a pair of spaced uprights 18, each having a lower end section 20, an intermediate section 22, an upper end section 24, a projection 25 secured to the lower end section 20, and a foot member 26 secured to lower end section 20, with each upright 18 being connected by a plurality of rungs 28 adjacent intermediate section 22 and foot member 26. Leg member 16 includes a pair of side members (unnumbered), each of which includes an upper end section 30, an intermediate section 32, a lower end section 34, a projection 35 secured to lower end section 34, and a foot member 36 secured to lower end section 34. The foot members 26 and 36 may be fixed to or pivotally secured to the lower ends 20 and 34 of respective uprights 18 of ladder member 14 and side members (unnumbered) of leg members 16. A brace and height adjustment mechanism 40 is pivotally connected to the projection 25 secured to the lower end section 20 of each upright 18 of ladder member 14 and to the projection 35 secured to the lower end section 34 of each leg member 16 for bracing and adjusting the height of frame 12. Each mechanism 40 includes a rod 42 having a plurality of holes 44 therethrough and being pivotally secured to a projection 25 of upright 18, a hollow tube 46 having a plurality of holes 48 therethrough and being pivotally secured to a projection 35 of leg member 16, the rod 42 being telescopically received in a respective hollow tube 46, and a pin 50 secured to a chain 52 for insertion in selected holes 44 and 48 to secure rod 42 to hollow tube 46. Rotatable drum 54 is fixed to a shaft 56 rotatably mounted in bearings 58 secured to uprights 18 adjacent the upper end section 24 thereof. The upper end section 30 of each side member of leg member 16 has a plate 31 secured thereto by any conventional means such as a weld and includes an opening (not shown) whose walls surround shaft 56 to pivotally secure each side member of leg member 16 to the uprights 18 of ladder member 14. A pawl 60 is pivotally fixed to the upper end section 24 of uprights 18 of ladder member 14 for engagement with teeth of a ratchet 62 fixed to shaft 56 for preventing unwanted movement (counterclockwise as shown in FIG. 1) of drum 54. Slide 70 includes a pair of spaced side members 71, a sheet 73 of polished sheet metal or plastic secured to spaced side members 71 by any conventional means such as welds, adhesives or the like, an upper end section 72, an upper intermediate section 74, a lower intermediate section 76, a pair of hollow tubular projections 77 secured to the underside of slide 70 by any conventional means such as welds with each projection 77 including a plurality of spaced holes 78 therethrough, and a lower end section 79. Each side member 71 may be covered with a foam or rubber cover 75. Slide 70 is pivotally secured to the upper end section 24 of the uprights 18 of ladder member 14 by any conventional means such as nuts and bolts. A slide support member 80 supports the slide 70 in the appropriate area of the lower intermediate section 76. Slide support member 80 comprises a U-shaped support element 82 having a base 84 and a pair of side members 86 with each side member 86 having plurality of holes (not shown) therethrough and being adapted to telescope within a respective hollow tubular projection 77 of slide 70. A pin 90 secured to a chain 92 is provided for insertion in a selected hole 78 and a selected hole (not shown) in side members 86 to adjustably secure the side members 86 of U-shaped support element 82 to a respective hollow tubular projection 77.

Figure 2:
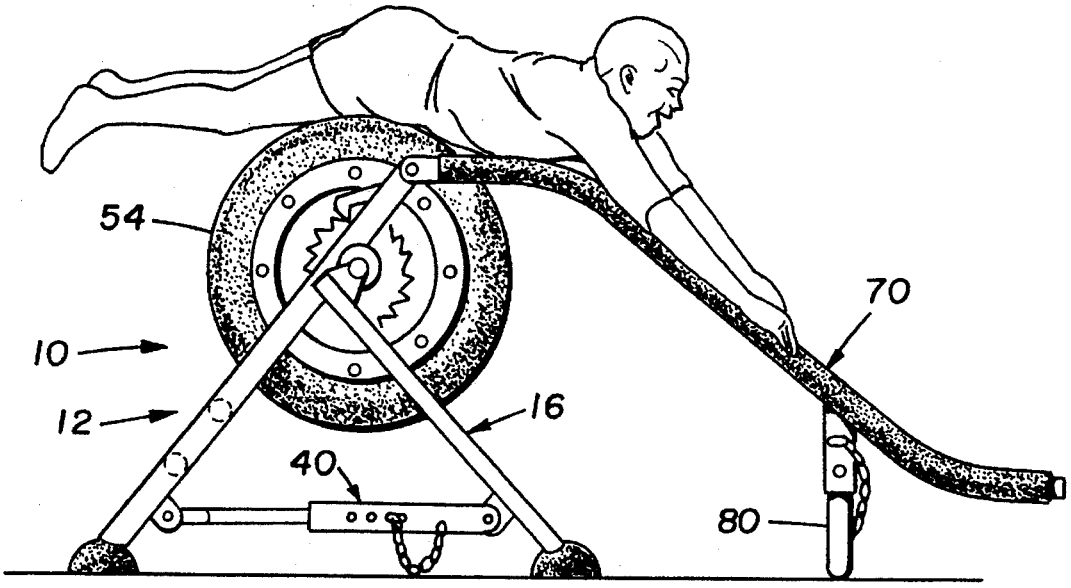
FIG. 2 is a side elevational view of the first embodiment of the teaching device of the present invention generally illustrating a person after mounting the device.
Figure 3:
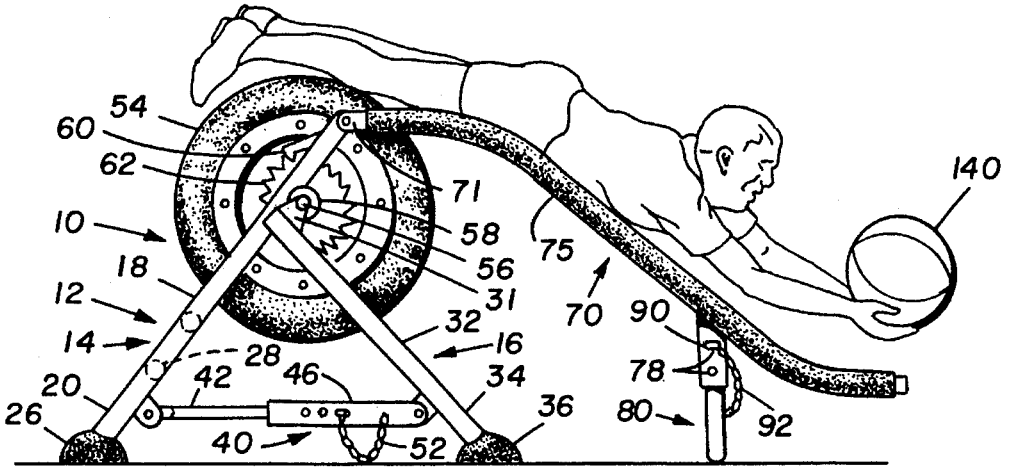
FIG. 3 is a side elevational view of the first embodiment of the teaching device of the present invention generally illustrating a person going down the slide and hitting a volleyball with his hands.
Figure 4:
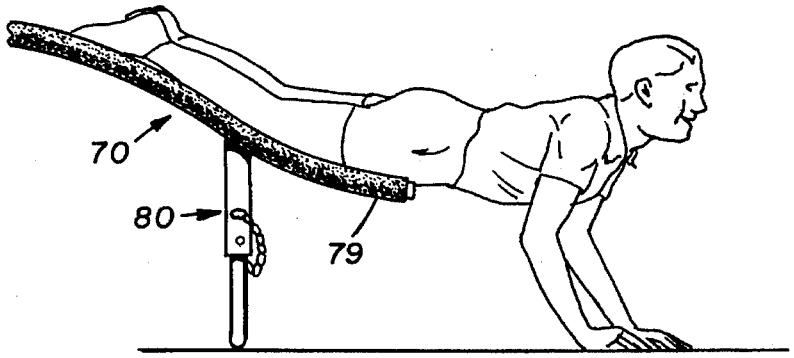
FIG. 4 is a partial side elevational view of the first embodiment of the teaching device of the present invention generally illustrating a person properly breaking the fall with the palms of both hands.

The teaching device 10 of the first embodiment of the invention is used in the following manner to teach a person the proper techniques for hitting a volleyball and breaking his fall when diving head first to hit a volleyball to reduce the possibility of injury to such person.

a. The person first mounts device 10 by standing on a selected rung or step 28 of ladder member 16.

b. The person then pushes on the selected rung or step 28 and places the front of his body over the drum 54 (to a position generally depicted in FIG. 2) at which time he commences going down slide 70.

c. When the person reaches a location on the slide (as generally depicted in FIG. 3) a volleyball is likewise thrown or placed in a location as generally depicted in FIG. 3 so that the person can hit the volleyball with either the palms or backs of his hands.

d. After hitting the volleyball (at the location generally depicted in FIG. 3) the person quickly lowers his arms and places the palms of his hands on the floor as generally depicted in FIG. 4 to break his fall, thus minimizing the chance of possible injury.

Figure 6:
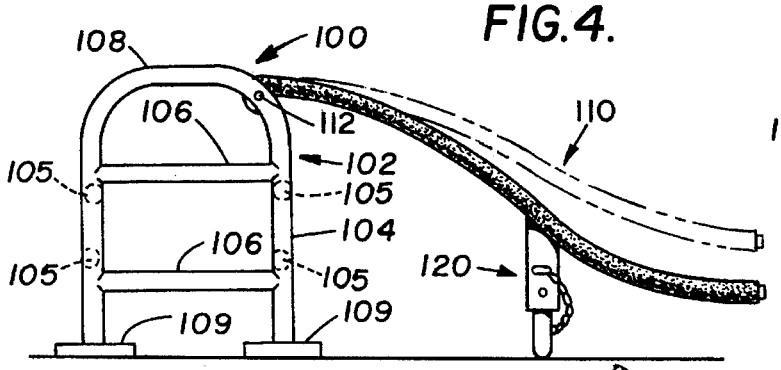
FIG. 6 is a side elevational view of the second embodiment of the teaching device of the present invention.
Figure 5:
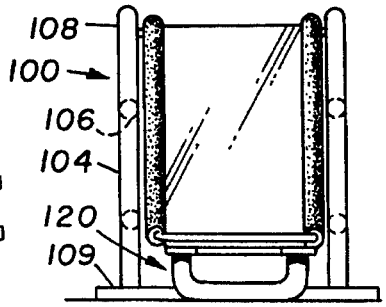
FIG. 5 is a transverse view of a second embodiment of the teaching device of the present invention.

A second embodiment of the teaching device of the present invention is depicted in FIGS. 5 and 6. In this embodiment of the invention, reference numeral 100 designates the teaching device which comprises a frame 102, a slide 110 and an adjustable U-shaped slide support element 120. Frame 102 includes a pair of spaced side members 104 connected by a plurality of spacer bars 105 (shown in dotted lines) which also serve as steps or rungs to enable a person to partially climb onto teaching device 100, a plurality of reinforcement members 106, a smooth, curved upper surface 108, and a plurality of foot members 109. Each spacer bar 105 and reinforcement member 106 is secured to the spaced side members 104 by any conventional means such as welds. The curved upper surface 108 may comprise a piece of sheet metal or plastic that is secured to the curved upper portion of side members 104 by any suitable, conventional, means such as welds or adhesives. The slide 100 and U-shaped slide support element 120 of the second embodiment are substantially identical to slide 70 and U-shaped slide support element 80 depicted in the embodiment of FIGS. 1–5 with the slide being pivoted to frame 102 by any conventional means such as nuts and bolts at point 112.

The teaching device of the second embodiment of the invention depicted in FIGS. 5 and 6 is used similarly to that of the first embodiment (FIGS. 1–4) as generally explained hereinabove.

Figure 7:
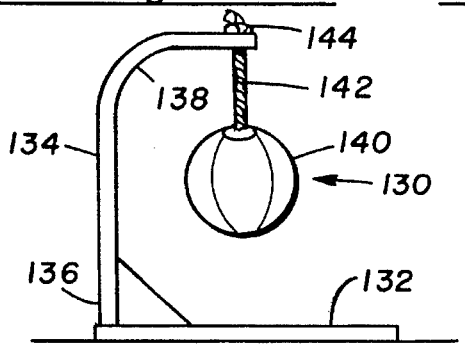
FIG. 7 is a plan view of an apparatus for supporting a volleyball for possible use with the teaching device of the present invention.

An accessory apparatus for use with either of the teaching devices 10 or 100 is depicted in FIG. 7 and is generally designated by reference numeral 130. Accessory apparatus 130 comprises a horizontal base plate 132, a vertical arm 134 having a lower portion 136 secured to base plate 132 by any suitable means such as welds and an upper portion 138 having an opening (not shown) therein. A volleyball 140 is suspended from upper portion 138 of vertical arm 134 by a rope or filament 142. Rope or filament 140 is secured to volleyball 140 by any conventional means such as an adhesive or sewing and to the upper portion 138 of vertical arm 134 by a knot 144 with the rope or filament 142 passing through the opening (not shown) in upper portion 138.

While the above description constitutes preferred embodiments of the present invention, it will be appreciated that the invention is susceptible to modification, variation and change without departing from the proper scope and fair meaning of the accompanying claims.

I claim:

1. A device for assisting in the instruction of persons learning techniques associated with playing volleyball, said device comprising:

a frame having an upper section, an intermediate section and a lower section;

a curved support means;

means for securing said curved support means to said frame; and a slide having an upper end section, an upper intermediate section, a lower intermediate section and a lower section, said upper end section being pivotally secured to said upper section of said frame.

2. The device of claim 1 further comprising means secured to said lower intermediate section of said slide for adjusting the height of said lower end section of said slide.

3. The device of claim 2 wherein said means for adjusting the height of said lower end section of said slide comprises at least one hollow tube having a plurality of holes therethrough, at least one rod having a plurality of holes therethrough and being pivotally secured to said projection of said slide and being telescopically received in said hollow tube, and at least one pin for insertion into selected holes in said rod and said hollow tube.

4. The device of claim 3 further comprising means on said frame adjacent its said lower section for allowing said person to climb up the said frame.

5. The device of claim 4 wherein said curved support means includes a drum rotatably fixed to said frame adjacent its said intermediate section.

6. The device of claim 5 further comprising means associated with said frame for adjusting the height of said rum rotatably secured to said frame.

7. The device of claim 6 wherein said means for allowing said person to climb up said frame comprises a ladder member and a leg member.

8. The device of claim 7 wherein said means for adjusting the height of said drum comprises at least one rod pivotally secured to said ladder member, at least one hollow tube pivotally secured to said leg member, and means for securing each said rod to each said hollow tube.

9. A device for assisting in the instruction of persons learning techniques associated with playing volleyball, said device comprising:

a frame having an upper section, an intermediate section and a lower section;

a drum;

means for rotatably securing said drum to said frame adjacent said intermediate section of said frame; and a slide having an upper end section, an upper intermediate section, a lower intermediate section and a lower section, said upper end section being pivotally secured to said upper section of said frame.

10. The device of claim 9 further comprising means secured to said lower intermediate section of said slide for adjusting the height of said lower end section of said slide.

11. The device of claim 10 wherein said means for adjusting the height of said lower end section of said slide comprises at least one hollow tube having a plurality of holes therethrough and being pivotally secured to said projection of said slide and being telescopically received in said hollow tube, and at least one pin for insertion into selected holes in said rod and said hollow tube.

12. The device of claim 11 further comprising means on said frame adjacent its said lower section for allowing said person to climb up the said frame.

13. The device of claim 12 further comprising means associated with said frame for adjusting the height of said drum rotatably secured to said frame.

14. The device of claim 13 wherein said means for allowing said person to climb up said frame comprises a ladder member and a leg member.

15. The device of claim 14 wherein said means for adjusting the height of said drum comprises at least one rod pivotally secured to said ladder member, at least one hollow tube pivotally secured to said leg member, and means for securing each said rod to each said hollow tube.

* * * * *